US010398283B2

(12) United States Patent
Feddema et al.

(10) Patent No.: US 10,398,283 B2
(45) **Date of Patent: *Sep. 3, 2019**

(54) DISHWASHER WITH SPRAYER

(71) Applicant: Whirlpool Corporation, Benton Harbor, MI (US)

(72) Inventors: Mark S. Feddema, Kalamazoo, MI (US); Chad T. Vanderroest, Covert, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 265 days.

This patent is subject to a terminal disclaimer.

(21) Appl. No.: 15/368,043

(22) Filed: Dec. 2, 2016

(65) Prior Publication Data

US 2017/0079504 A1 Mar. 23, 2017

Related U.S. Application Data

(63) Continuation of application No. 13/782,147, filed on Mar. 1, 2013, now Pat. No. 9,532,701.

(51) Int. Cl.
*A47L 15/23* (2006.01)
*A47L 15/42* (2006.01)
(Continued)

(52) U.S. Cl.
CPC ..... *A47L 15/4282* (2013.01); *A47L 15/23* (2013.01); *A47L 15/428* (2013.01);
(Continued)

(58) Field of Classification Search
CPC ..... A47L 15/42; A47L 15/22; A47L 15/23; A47L 15/4223; A47L 15/4282;
(Continued)

(56) References Cited

U.S. PATENT DOCUMENTS 1,750,170 A 3/1930 Frisch
1,966,572 A 7/1934 Webb
(Continued)

FOREIGN PATENT DOCUMENTS

DE 7024995 U 6/1970
DE 4036930 A1 5/1992
(Continued)

OTHER PUBLICATIONS

Machine translation of DE 102005026558 B3, dated Jun. 2005. (Year: 2005).*
(Continued)

*Primary Examiner* — Joseph L. Perrin
*Assistant Examiner* — Kevin G Lee
(74) *Attorney, Agent, or Firm* — McGarry Bair PC

(57) ABSTRACT

A dishwasher includes a tub at least partially defining a treating chamber and a sprayer for spraying liquid to the treating chamber. The sprayer may include a liquid passage provided in the interior of the body, at least one upper outlet extending through the upper surface of the body and in fluid communication with the liquid passage, at least one lower outlet extending through the lower surface of the body and in fluid communication with the liquid passage, and a valve body moveable relative to the body to fluidly couple the at least one upper outlet and the at least one lower outlet to the liquid passage.

19 Claims, 5 Drawing Sheets

(51) Int. Cl.
*B05B 1/30* (2006.01)
*B05B 1/16* (2006.01)
*B05B 3/14* (2006.01)

(52) U.S. Cl.
CPC ..... *B05B 1/1663* (2013.01); *B05B 1/3026* (2013.01); *A47L 2501/02* (2013.01); *B05B 3/14* (2013.01)

(58) Field of Classification Search
CPC ..... A47L 2501/02; B05B 1/16; B05B 1/1609; B05B 3/14; B05B 3/00; B05B 1/1627; B05B 1/1663; B05B 1/1681; B05B 1/3026; F16K 3/0254
See application file for complete search history.

(56) References Cited

U.S. PATENT DOCUMENTS

| | | | |
|---|---|---|---|
| 1,997,450 | A | 4/1935 | Burkle |
| 2,694,769 | A | 11/1954 | Huck et al. |
| 3,009,648 | A | 11/1961 | Hait |
| 3,064,664 | A | 11/1962 | Warhus |
| 3,064,665 | A | 11/1962 | Martiniak |
| 3,146,953 | A | 9/1964 | Komanns |
| 3,160,164 | A | 12/1964 | Constance |
| 3,253,784 | A | 5/1966 | Long et al. |
| 3,598,130 | A | 8/1971 | Nolte et al. |
| 3,709,236 | A | 1/1973 | Field et al. |
| 3,771,725 | A | 11/1973 | Jenkins et al. |
| 3,797,509 | A | 3/1974 | Fukuzawa et al. |
| 3,918,644 | A | 11/1975 | Platt |
| 3,997,760 | A | 12/1976 | Salinger |
| 4,266,565 | A | 5/1981 | Gurubatham |
| 4,509,687 | A | 4/1985 | Cushing |
| 4,594,500 | A | 6/1986 | Wright |
| 4,924,069 | A | 5/1990 | Giordani |
| 4,993,444 | A | 2/1991 | Toriyama et al. |
| 5,331,986 | A | 7/1994 | Lim et al. |
| 5,415,350 | A | 5/1995 | Yoon et al. |
| 5,427,129 | A | 6/1995 | Young, Jr. et al. |
| 2,726,666 | A | 12/1995 | Oxford |
| 5,546,968 | A | 8/1996 | Jeon et al. |
| 5,577,665 | A | 11/1996 | Chang |
| 5,601,100 | A | 2/1997 | Kawakami et al. |
| 5,609,174 | A | 3/1997 | Ferguson |
| 5,655,556 | A | 8/1997 | Guerrera et al. |
| 5,662,744 | A | 9/1997 | Tuller et al. |
| 5,673,714 | A | 10/1997 | Campagnolo et al. |
| 5,692,885 | A | 12/1997 | Langer |
| 5,697,392 | A | 12/1997 | Johnson et al. |
| 5,944,037 | A | 8/1999 | Sinyong et al. |
| 5,964,232 | A | 10/1999 | Chung |
| 6,053,185 | A | 4/2000 | Beevers |
| 6,325,083 | B1 | 12/2001 | Worter |
| 6,692,093 | B1 | 2/2004 | Park et al. |
| 6,736,598 | B2 | 5/2004 | Kleemann et al. |
| 7,287,536 | B2 | 10/2007 | Steck et al. |
| 7,293,958 | B2 | 11/2007 | Kraffzik |
| 7,314,188 | B2 | 1/2008 | Watson et al. |
| 7,331,356 | B2 | 2/2008 | VanderRoest et al. |
| 7,445,013 | B2 | 11/2008 | VanderRoest et al. |
| 7,455,065 | B2 | 11/2008 | Schrott |
| 7,475,696 | B2 | 1/2009 | VanderRoest et al. |
| 7,493,907 | B2 | 2/2009 | Roh |
| 7,523,758 | B2 | 4/2009 | VanderRoest et al. |
| 7,560,672 | B2 | 7/2009 | Pleschinger et al. |
| 7,594,513 | B2 | 9/2009 | VanderRoest et al. |
| 7,673,639 | B2 | 3/2010 | Shin |
| 7,810,512 | B2 | 10/2010 | Pyo et al. |
| 7,896,977 | B2 | 3/2011 | Gillum et al. |
| 7,935,194 | B2 | 5/2011 | Rolek |
| 7,959,744 | B2 | 6/2011 | Sundaram et al. |
| 7,965,928 | B2 | 6/2011 | Eichholz et al. |
| 7,980,260 | B2 | 7/2011 | Bertsch et al. |
| 8,113,222 | B2 | 2/2012 | Bertsch et al. |
| 8,137,479 | B2 | 3/2012 | Vanderroest et al. |
| 8,187,390 | B2 | 5/2012 | Vanderroest et al. |
| 8,210,191 | B2 | 7/2012 | Gnadinger |
| 8,245,718 | B2 | 8/2012 | Busing et al. |
| 8,282,741 | B2 | 10/2012 | Bertsch et al. |
| 8,989,566 | B2 | 3/2015 | Liu et al. |
| 9,402,526 | B2 | 8/2016 | Bertsch et al. |
| 9,532,699 | B2 | 1/2017 | Feddema |
| 9,839,340 | B2 | 12/2017 | Feddema |
| 2006/0011221 | A1 | 1/2006 | Schrott |
| 2006/0054201 | A1 | 3/2006 | Yoon et al. |
| 2006/0108454 | A1 | 5/2006 | Eichholz |
| 2006/0278258 | A1 | 12/2006 | Kara et al. |
| 2007/0056613 | A1 | 3/2007 | Haas et al. |
| 2007/0289615 | A1 | 12/2007 | Shin |
| 2009/0071508 | A1 | 3/2009 | Sundaram et al. |
| 2009/0101182 | A1 | 4/2009 | Buesing et al. |
| 2009/0101185 | A1 | 4/2009 | Pardini |
| 2009/0159103 | A1 | 6/2009 | Gillum et al. |
| 2010/0108102 | A1 | 5/2010 | Kehl et al. |
| 2010/0139719 | A1 | 6/2010 | Gnadinger et al. |
| 2010/0252081 | A1 | 10/2010 | Classen et al. |
| 2011/0030742 | A1 | 2/2011 | Dalsing et al. |
| 2011/0146714 | A1 | 6/2011 | Fountain et al. |
| 2011/0146730 | A1 | 6/2011 | Welch |
| 2011/0146731 | A1 | 6/2011 | Fountain et al. |
| 2011/0203619 | A1 | 8/2011 | Kara et al. |
| 2011/0284039 | A1 | 11/2011 | Christie |
| 2011/0303250 | A1 | 12/2011 | Delgado et al. |
| 2012/0118330 | A1 | 5/2012 | Tuller et al. |
| 2012/0118336 | A1 | 5/2012 | Welch |
| 2012/0138096 | A1 | 6/2012 | Tuller et al. |
| 2012/0138106 | A1 | 6/2012 | Fountain et al. |
| 2012/0138107 | A1 | 6/2012 | Fountain et al. |
| 2012/0138111 | A1 | 6/2012 | Tuller et al. |
| 2012/0167928 | A1 | 7/2012 | Fountain et al. |
| 2012/0279530 | A1 | 11/2012 | Thiyagarajan |
| 2012/0279536 | A1 | 11/2012 | Adams et al. |
| 2013/0074886 | A1 | 3/2013 | Feddema et al. |
| 2013/0074887 | A1 | 3/2013 | Feddema |
| 2013/0074888 | A1 | 3/2013 | Feddema |
| 2013/0074890 | A1 | 3/2013 | Feddema et al. |
| 2013/0074891 | A1 | 3/2013 | Bertsch et al. |
| 2014/0054395 | A1 | 2/2014 | Heisele et al. |
| 2014/0137909 | A1 | 5/2014 | Baldwin et al. |
| 2014/0246059 | A1 | 9/2014 | Feddema |
| 2014/0246060 | A1 | 9/2014 | Feddema et al. |
| 2014/0332041 | A1 | 11/2014 | Feddema |
| 2015/0044073 | A1 | 2/2015 | Badafem et al. |
| 2015/0086325 | A1 | 3/2015 | Koebrich et al. |

FOREIGN PATENT DOCUMENTS

| | | | |
|---|---|---|---|
| DE | 20208544 | U1 | 10/2002 |
| DE | 102005026558 | B3 | 11/2006 |
| DE | 202008015058 | U1 | 3/2009 |
| DE | 102010043019 | A1 | 5/2012 |
| DE | 102011053666 | A1 | 5/2012 |
| EP | 0524102 | A1 | 1/1993 |
| EP | 0764421 | A1 | 3/1997 |
| EP | 0795292 | A2 | 9/1997 |
| EP | 0943281 | A2 | 9/1999 |
| EP | 0943282 | A2 | 9/1999 |
| EP | 1040786 | A1 | 10/2000 |
| EP | 1040787 | A1 | 10/2000 |
| EP | 1224902 | A2 | 7/2002 |
| EP | 1252856 | A2 | 10/2002 |
| EP | 1277430 | A1 | 1/2003 |
| EP | 1334687 | A1 | 8/2003 |
| EP | 1386575 | B1 | 10/2005 |
| EP | 1247993 | B1 | 3/2009 |
| EP | 2292134 | A1 | 3/2011 |
| EP | 2572622 | A1 | 3/2013 |
| EP | 2572623 | A1 | 3/2013 |
| EP | 2572624 | A1 | 3/2013 |
| GB | 2019204 | A | 10/1979 |
| GB | 2199734 | A | 7/1988 |
| GB | 2215990 | A | 10/1989 |
| JP | 60053120 | | 3/1985 |

(56) References Cited

FOREIGN PATENT DOCUMENTS

| | | | |
|---|---|---|---|
| JP | 4033632 | A | 2/1992 |
| JP | 5184514 | A | 7/1993 |
| JP | 08089467 | A | 4/1996 |
| JP | 8089467 | A | 4/1996 |
| JP | 9164107 | A | 6/1997 |
| JP | 10243910 | A | 9/1998 |
| JP | 11019019 | A | 1/1999 |
| JP | 11076127 | A | 3/1999 |
| JP | 2004113683 | A | 4/2004 |
| KR | 200156558 | Y1 | 9/1999 |
| KR | 20060029567 | A | 4/2006 |
| KR | 20090037299 | A | 4/2009 |
| WO | 2010012703 | A2 | 2/2010 |
| WO | 2011144540 | A2 | 11/2011 |
| WO | 2011154471 | A1 | 12/2011 |
| WO | 2012065873 | A2 | 5/2012 |

OTHER PUBLICATIONS

European Search Report for Corresponding EP14173784.1, dated Oct. 29, 2014.
European Search Report for Corresponding EP14177086.7, dated Oct. 20, 2014.
European Search Report for Corresponding EP14155441.0, dated May 30, 2014.
German Search Report for Counterpart DE102013111241.2, dated May 23, 2014.
European Search Report for Corresponding EP14155444.4. dated May 26. 2014.
European Search Report for Corresponding EP 12185510.0, dated Dec. 19, 2012.
European Search Report for Corresponding EP 12185514.2, dated Dec. 6, 2012.
European Search Report for Corresponding EP 12185512.6, dated Dec. 6, 2012.

* cited by examiner

DISHWASHER WITH SPRAYER

CROSS-REFERENCE TO RELATED APPLICATION(S)

This application is a continuation of U.S. patent application Ser. No. 13/782,147, filed Mar. 1, 2013, now U.S. Pat. No. 9,532,701, which is incorporated herein by reference in its entirety.

BACKGROUND OF THE INVENTION

Contemporary automatic dishwashers for use in a typical household include a tub and at least one rack or basket for supporting soiled dishes within the tub. A spraying system may be provided for recirculating liquid throughout the tub to remove soils from the dishes. The spraying system may include various sprayers including a rotatable sprayer.

SUMMARY

An embodiment of the invention relates to a dishwasher having a tub at least partially defining a treating chamber, a spraying system supplying liquid to the treating chamber and having a sprayer with a body, a liquid passage provided in the interior of the body, at least one upper outlet extending through the upper surface of the body and in fluid communication with the liquid passage, at least one lower outlet extending through the lower surface of the body and in fluid communication with the liquid passage, and a valve body moveable relative to the body to alternately fluidly couple the at least one upper outlet and the at least one lower outlet to the liquid passage.

Another embodiment of the invention relates to a dishwasher having a tub at least partially defining a treating chamber, a spraying system supplying liquid to the treating chamber and having a sprayer with a body, a liquid passage provided in the interior, at least one upper outlet extending through the upper surface of the body and in fluid communication with the liquid passage, at least one lower outlet extending through the lower surface of the body and in fluid communication with the liquid passage, and a valve body moveable relative to the body to selectively fluidly couple the at least one upper outlet and the at least one lower outlet to the liquid passage and wherein the at least one upper outlet and the at least one lower outlet are periodically simultaneously coupled to the liquid passage.

DESCRIPTION OF EMBODIMENTS OF THE INVENTION

Figure 1:
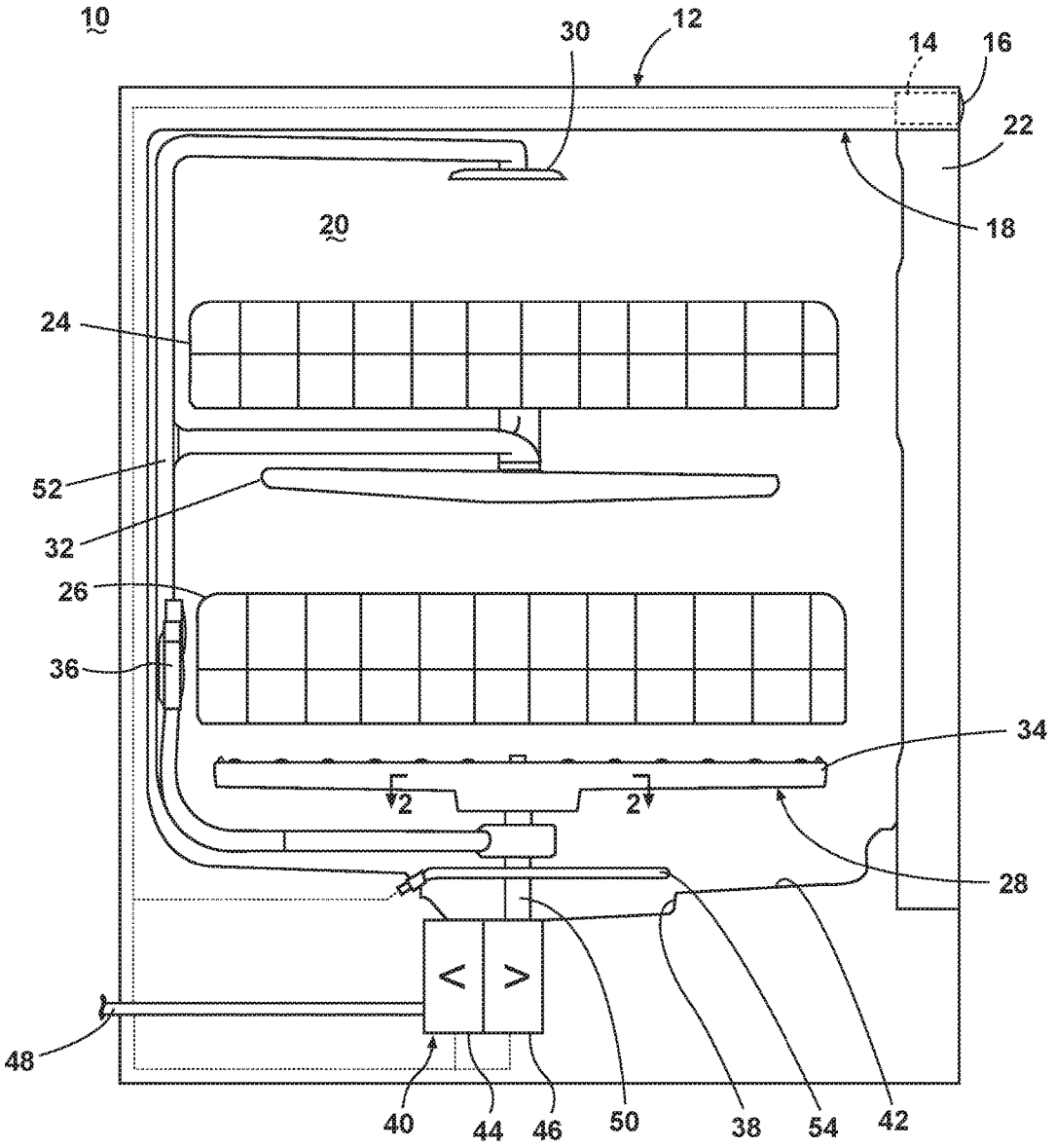
FIG. 1 is a schematic view of a dishwasher with a spray system according to an embodiment of the invention.

Referring to FIG. 1, an automatic dishwasher 10 having a cabinet 12 defining an interior is illustrated. Depending on whether the dishwasher 10 is a stand-alone or built-in, the cabinet 12 may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A controller 14 may be located within the cabinet 12 and may be operably coupled with various components of the dishwasher 10 to implement one or more cycles of operation. A control panel or user interface 16 may be provided on the dishwasher 10 and coupled with the controller 14. The user interface 16 may include operational controls such as dials, lights, switches, and displays enabling a user to input commands, such as a cycle of operation, to the controller 14 and receive information.

A tub 18 is located within the cabinet 12 and at least partially defines a treating chamber 20 with an access opening in the form of an open face. A cover, illustrated as a door 22, may be hingedly mounted to the cabinet 12 and may move between an opened position, wherein the user may access the treating chamber 20, and a closed position, as shown in FIG. 1, wherein the door 22 covers or closes the open face of the treating chamber 20.

Utensil holders in the form of upper and lower racks 24, 26 are located within the treating chamber 20 and receive dishes for being treated. The racks 24, 26 are mounted for slidable movement in and out of the treating chamber 20 for ease of loading and unloading. As used in this description, the term "dish(es)" is intended to be generic to any item, single or plural, that may be treated in the dishwasher 10, including, without limitation; utensils, plates, pots, bowls, pans, glassware, and silverware. While not shown, additional utensil holders, such as a silverware basket on the interior of the door 22, may also be provided.

A spraying system 28 may be provided for spraying liquid into the treating chamber 20 and is illustrated in the form of an upper sprayer 30, a mid-level rotatable sprayer 32, a lower rotatable spray arm 34, and a spray manifold 36. The upper sprayer 30 may be located above the upper rack 24 and is illustrated as a fixed spray nozzle that sprays liquid downwardly within the treating chamber 20. Mid-level rotatable sprayer 32 and lower rotatable spray arm 34 are located, respectively, beneath upper rack 24 and lower rack 26 and are illustrated as rotating spray arms. The mid-level spray arm 32 may provide a liquid spray upwardly through the bottom of the upper rack 24. The lower rotatable spray arm 34 may provide a liquid spray upwardly through the bottom of the lower rack 26. The mid-level rotatable sprayer 32 may optionally also provide a liquid spray downwardly onto the lower rack 26, but for purposes of simplification, this will not be illustrated herein.

The spray manifold 36 may be fixedly mounted to the tub 18 adjacent to the lower rack 26 and may provide a liquid spray laterally through a side of the lower rack 26. The spray manifold 36 may not be limited to this position; rather, the spray manifold 36 may be located in virtually any part of the treating chamber 20. While not illustrated herein, the spray manifold 36 may include multiple spray nozzles having apertures configured to spray wash liquid towards the lower rack 26. The spray nozzles may be fixed or rotatable with respect to the tub 18.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recessed portion of a bottom wall 42 of the tub 18. The pump assembly 40 may include both a drain pump 44 and a recirculation pump 46.

The drain pump 44 may draw liquid from the sump 38 and pump the liquid out of the dishwasher 10 to a household drain line 48. The recirculation pump 46 may draw liquid from the sump 38 and pump the liquid to the spraying system 28 to supply liquid into the treating chamber 20. While the pump assembly 40 is illustrated as having separate drain and recirculation pumps 44, 46 in an alternative embodiment, the pump assembly 40 may include a single pump configured to selectively supply wash liquid to either the spraying system 28 or the drain line 48, such as by configuring the pump to rotate in opposite directions, or by providing a suitable valve system. While not shown, a liquid supply system may include a water supply conduit coupled with a household water supply for supplying water to the sump 38.

As shown herein, the recirculation pump 46 has an outlet conduit 50 in fluid communication with the spraying system 28 for discharging wash liquid from the recirculation pump 46 to the sprayers 30-36. As illustrated, liquid may be supplied to the spray manifold 36, mid-level rotatable sprayer 32, and upper sprayer 30 through a supply tube 52 that extends generally rearward from the recirculation pump 46 and upwardly along a rear wall of the tub 18. While the supply tube 52 ultimately supplies liquid to the spray manifold 36, mid-level rotatable sprayer 32, and upper sprayer 30, it may fluidly communicate with one or more manifold tubes that directly transport liquid to the spray manifold 36, mid-level rotatable sprayer 32, and upper sprayer 30. Further, diverters (not shown) may be provided within the spraying system 28 such that liquid may be selectively supplied to each of the sprayers 30-36. The sprayers 30-36 spray water and/or treating chemistry onto the dish racks 24, 26 (and hence any dishes positioned thereon) to effect a recirculation of the liquid from the treating chamber 20 to the liquid spraying system 28 to define a recirculation flow path.

A heating system having a heater 54 may be located within or near the sump 38 for heating liquid contained in the sump 38. A filtering system (not shown) may be fluidly coupled with the recirculation flow path for filtering the recirculated liquid.

Figure 2:
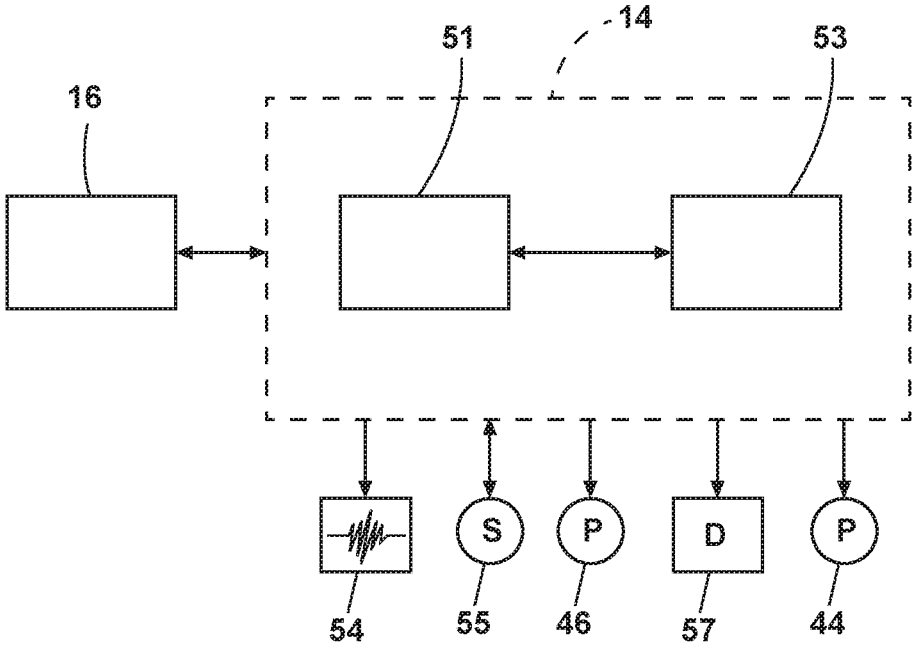
FIG. 2 is a schematic view of a control system of the dishwasher of FIG. 1.

As illustrated in FIG. 2, the controller 14 may be provided with a memory 51 and a central processing unit (CPU) 53. The memory 51 may be used for storing control software that may be executed by the CPU 53 in completing a cycle of operation using the dishwasher 10 and any additional software. For example, the memory 51 may store one or more pre-programmed cycles of operation that may be selected by a user and completed by the dishwasher 10. A cycle of operation for the dishwasher 10 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of water and/or rinse aid used during each of the multiple rinse steps may be varied. The drying step may have a non-heated drying step (so called "air only"), a heated drying step or a combination thereof. These multiple steps may also be performed by the dishwasher 10 in any desired combination.

The controller 14 may be operably coupled with one or more components of the dishwasher 10 for communicating with and controlling the operation of the components to complete a cycle of operation. For example, the controller 14 may be coupled with the recirculation pump 46 for circulation of liquid in the tub 18 and the drain pump 44 for drainage of liquid in the tub 18. The controller 14 may also be operably coupled to the heater 54. Further, the controller 14 may also be coupled with one or more optional sensors 55. Non-limiting examples of optional sensors 55 that may be communicably coupled with the controller 14 include a moisture sensor, a door sensor, a temperature sensor, a detergent and rinse aid presence/type sensor(s). The controller 14 may also be coupled to a dispenser 57, which may dispense a detergent during the wash step of the cycle of operation or a rinse aid during the rinse step of the cycle of operation.

Figure 3A:
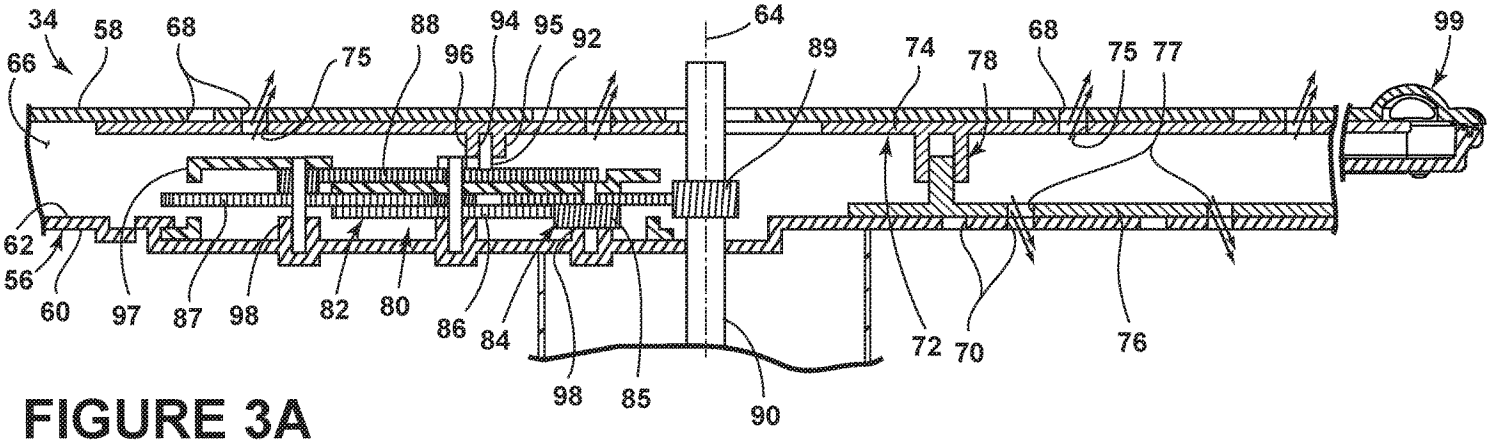
FIGS. 3A-3B are cross-sectional views of a rotatable spray arm of the spray system of the dishwasher of FIG. 1 and illustrating a valve body for the rotatable spray arm in various positions.

FIG. 3A illustrates a cross-sectional view of the lower rotatable spray arm 34 comprising a body 56 having an upper surface 58, a lower surface 60, and an interior 62 and mounted within the tub 18 for movement about a rotatable axis 64. A liquid passage 66 may be provided in the interior 62 and fluidly couples with the outlet conduit 50 and recirculation pump 46. As illustrated, the interior 62 defines the liquid passage 66. However, a separate liquid passage 66 may be located within the interior 62.

At least one upper outlet 68 may extend through the upper surface 58 of the body 56 and may be in fluid communication with the liquid passage 66. A plurality of upper outlets 68 have been illustrated as being included in the body 56. At least one lower outlet 70 may extend through the lower surface 60 of the body 56 and may be in fluid communication with the liquid passage 66. A plurality of lower outlets 70 have been illustrated as being included in the body 56. The upper outlets 68 and lower outlets 70 may be located and spaced in any suitable manner. In the illustrated example the number of upper outlets 68 exceeds the number of lower outlets 70 although this need not be the case.

A valve body 72 is illustrated as being located within the interior 62 and may be moveable relative to the body 56 to selectively fluidly couple at least some of the upper outlets 68 and at least some of the lower outlets 70 to the liquid passage 66. The upper outlets 68 and the lower outlets 70 may be periodically simultaneously coupled to the liquid passage 66. The valve body 72 may be reciprocally moveable within the body 56.

The valve body 72 has been illustrated as including an upper slidable plate 74 having at least one opening 75 and a lower slidable plate 76 having at least one opening 77. The at least one opening 75 aligns with at least one upper outlet 68 and the at least one opening 77 aligns with at least one lower outlet 70. Multiple openings 75 may be included in the upper slidable plate 74 and multiple openings 77 may be included in the lower slidable plate 76 such that multiple upper outlets 68 and lower outlets 70 may be fluidly coupled to the liquid passage 66. The upper slidable plate 74 and the lower slidable plate 76 may be slidably mounted within the interior 62 of the body 56 of the rotatable spray arm 34 for movement therein to selectively fluidly couple at least some of the upper outlets 68 and at least some of the lower outlets 70 to the liquid passage 66.

The upper slidable plate 74 and lower slidable plate 76 may be formed in any suitable manner and may or may not be similarly formed. For example, the upper slidable plate 74 and lower slidable plate 76 may include a rigid plate, a flexible plate, or a thin film plate, which may be either flexible or rigid. For example, the upper slidable plate 74 may include an upper membrane with the openings 75 formed therein and the lower slidable plate 76 may include a lower membrane and with the openings 77 therein. The upper membrane may abut the upper surface 58 and the lower membrane may abut lower surface 60. The membranes may conform to the shape of the sprayer and may form a liquid seal between the portions of the body 56 and the liquid passage 66.

The upper slidable plate 74 has been illustrated as being operably coupled with the lower slidable plate 76 such that they may move in tandem. Any suitable coupling mechanism 78 may be used. Alternatively, the upper slidable plate 74 and the lower slidable plate 76 may be formed from a single piece and may not require a coupling mechanism. Further still, the upper slidable plate 74 and the lower slidable plate 76 may not be coupled. In such an instance, the upper slidable plate 74 and the lower slidable plate 76 may still move in tandem or may be configured to move separately.

Regardless of whether the upper slidable plate 74 and the lower slidable plate 76 are coupled, an actuator 80 may be operably coupled with the valve body 72 and may move the valve body 72 based on the rotation of the lower rotatable spray arm 34. The actuator 80 may be any suitable mechanism capable of moving the valve body 72 based on the rotation of the lower rotatable spray arm 34. By way of a non-limiting example, the actuator 80 may include a drive system 82 operably coupled with the lower rotatable spray arm 34 and the valve body 72 such that rotation of the lower rotatable spray arm 34 moves the valve body 72. The drive system 82 has been illustrated as including a gear assembly 84 operably coupling the lower rotatable spray arm 34 and the valve body 72 such that rotation of the lower rotatable spray arm 34 moves the gear assembly 84 which in turn moves the upper slidable plate 74 and the lower slidable plate 76. Thus, the gear assembly 84 helps convert the rotational motion of the lower rotatable spray arm 34 into sliding motion for the upper slidable plate 74 and the lower slidable plate 76. The gear assembly 84 has been illustrated as including a gear chain having a first gear 85, second gear 86, third gear 87, fourth gear 88, and a fixed gear 89. A fixed shaft 90 may extend through a portion of the body 56 such that the lower rotatable spray arm 34 is rotationally mounted on the fixed shaft 90. Further, the fixed gear 89 may be fixedly mounted on the fixed shaft 90.

The drive system 82 further comprises a pin 92 operably coupled with and extending from an upper portion of the fourth gear 88 and received within a channel 94 located in the valve body 72 to operably couple the gear assembly 84 with the upper slidable plate 74. The channel 94 may be a depression in a bottom portion of the upper slidable plate 74 or as illustrated may be formed between two opposing walls 95, 96 extending downwardly from the bottom of the upper slidable plate 74. A bracket 97 may be located within the interior 62 and houses at least a portion of the gear assembly 84 to provide support for the gear assembly 84. Portions of the gear assembly 84 may also be held within supports 98 formed by the body 56 of the lower rotatable spray arm assembly 34.

The operation of the dishwasher 10 with the described lower rotatable spray arm structure will now be described. The user will initially select a cycle of operation via the user interface 16, with the cycle of operation being implemented by the controller 14 controlling various components of the dishwasher 10 to implement the selected cycle of operation in the treating chamber 20. Examples of cycles of operation include normal, light/china, heavy/pots and pans, and rinse only. The cycles of operation may include one or more of the following steps: a wash step, a rinse step, and a drying step. The wash step may further include a pre-wash step and a main wash step. The rinse step may also include multiple steps such as one or more additional rinsing steps performed in addition to a first rinsing. During such cycles, wash fluid, such as water and/or treating chemistry (i.e., water and/or detergents, enzymes, surfactants, and other cleaning or conditioning chemistry) passes from the recirculation pump 46 into the spraying system 28 and then exits the spraying system through the sprayers 30-36.

The lower rotatable spray arm 34 may rely on liquid pumped from the recirculation pump 46 to provide hydraulic drive to rotate the lower rotatable spray arm 34, which through the actuator 80 affects the movement of the valve body 72. More specifically, a hydraulic drive 99 may be formed by an outlet in the body 56 being oriented such that liquid emitted from the hydraulic drive outlet 99 effects the rotation of the lower rotatable spray arm 34. The lower rotatable spray arm 34 may have any number of hydraulic drive outlets 99 and these hydraulic drive outlets 99 may be located such that when the recirculation pump 46 is activated, the lower rotatable spray arm 34 rotates regardless of the position of the valve body 72. It has also been contemplated that such hydraulic drive outlets 99 may be located on various portions of the body 56 including a side or bottom portion of the body 56.

As the lower rotatable spray arm 34 is hydraulically rotated about the fixed shaft 90, the first gear 85, which is mounted between the fixed gear 89 and the second gear 86, is rotatably mounted within the support 98, and moves with the rotation of the lower rotatable spray arm 34, may be driven around the fixed gear 89. Thus, the first gear 85 is also hydraulically driven and may be caused to circle about the fixed gear 89 as the lower rotatable spray arm 34 rotates about the fixed shaft 90. As the first gear 85 is driven about the fixed gear 89, it in turn causes the rotation of the second gear 86, the third gear 87, and the fourth gear 88.

As the fourth gear 88 rotates, the pin 92 rotates within the interior 62 of the lower rotatable spray arm 34. As the pin 92 rotates, it moves within the boundaries of the channel 94 and causes the upper slidable plate 74 to be moved back and forth within the interior 62 of the lower rotatable spray arm 34. More specifically, as the pin 92 rotates with the fourth gear 88, the pin 92 pushes on the wall 95 for a first portion of a full rotation of the fourth gear 88 and pushes on the wall 96 for a second portion of the full rotation of the fourth gear 88.

In this manner, the actuator 80 reciprocally moves the valve body 72 within the body 56 based on the rotation of the body 56. As the upper slidable plate 74 moves back and forth, the lower slidable plate 76 moves with it in tandem. When the pin 92 pushes on the wall 95 it moves the upper slidable plate 74 and lower slidable plate 76 to a first position, illustrated in FIG. 3A. In the first position, multiple openings 75 fluidly couple multiple upper outlets 68 to the liquid passage 66 and multiple openings 77 fluidly couple multiple lower outlets 70 to the liquid passage 66. In this manner, at least some of the upper outlets 68 and the lower outlets 70 are simultaneously coupled to the liquid passage 66. During the simultaneous coupling the valve body 72 may fluidly couple more upper outlets 68 to the liquid passage 66 than lower outlets 68.

Figure 3B:
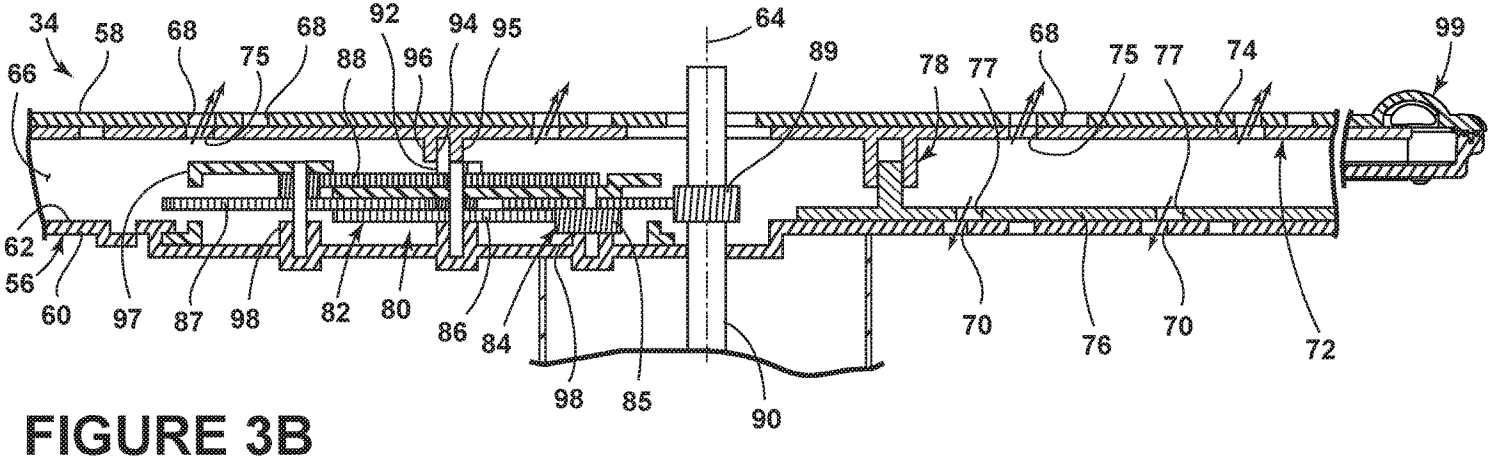

The upper slidable plate 74 and lower slidable plate 76 may stay in the first position until the pin 92 is rotationally advanced to a point where it begins to push on the wall 96. When the pin 92 pushes on the wall 96 it moves the upper slidable plate 74 in the opposite direction. As the upper slidable plate 74 is moved the lower slidable plate 76 moves with it until both reach a second position, which is illustrated in FIG. 3B. In the second position, the valve body 72 fluidly couples alternative upper outlets 68 and lower outlets 70 to the liquid passage 66 as compared to when the valve body 72 was in the first position. In the first position, the amount of liquid emitted from each of the upper outlets 68 and the lower outlets 70 has been illustrated as being the same while in the second position, the amount of liquid emitted varies between the upper outlets 68 and the lower outlets 70. More specifically, the flow of liquid emitted from the lower outlets 70 is illustrated as being less than the liquid emitted from the upper outlets 68.

The upper slidable plate 74 and the lower slidable plate 76 may stay in the second position until the pin 92 is rotationally advanced to a point where it begins to again push on the wall 95. As the fourth gear 88 continues to rotate, the pin 92 continues to alternatively push against one of the walls 95 and 96 and continues to move the upper slidable plate 74 and the lower slidable plate 76 into the first and second positions. In this manner, the actuator 80 allows the valve body 72 to move between the at least two positions based on a rotational position of the lower rotatable spray arm 34.

As the upper slidable plate 74 and the lower slidable plate 76 move side to side, the force and shape of the pattern of the sprays emitted from the upper outlets 68 and the lower outlets 70 may also change. As the openings 75 and 77 come into alignment with the upper outlets 68 and the lower outlets 70, respectively, the effective outlet or nozzle becomes wider, and a more diffused, wide-angle spray pattern may be emitted from the effective nozzle that produces a shower spray of liquid from the lower rotatable spray arm 34. Conversely, as the upper outlets 68 and the lower outlets 70 are overlapped with the solid plate portions of the upper slidable plate 74 and lower slidable plate 76, respectively, the effective nozzle becomes smaller, and a more discrete, focused, and concentrated the spray pattern may be emitted from the effective nozzle, which may provide a higher pressure spray from the lower rotatable spray arm 34. The shower spray may be more suitable for distributing treating chemistry whereas the higher pressure spray may be more suitable for dislodging soils. The different spray patterns, including the differing directions of spray, created may provide for different cleaning effects from the lower rotatable spray arm 34.

When the valve body 72 is located intermediately of the first and second positions, water may be still be sprayed from some of the upper outlets 68 and lower outlets 70 if at least a portion of the openings 75 and 77 fluidly couples a portion of the upper outlets 68 and lower outlets 70. It is also contemplated that when the valve body 72 is located intermediately of the first and second positions that liquid may be emitted from only the upper outlets 68 or the lower outlets 70 such that the upper outlets 68 and the lower outlets 70 are not simultaneously coupled to the liquid passage 66. It has also been contemplated that the valve body 72 may be shaped such that there may be a point where the outlets in the valve body 72 do not allow for the fluid to enter any of the upper outlets 68 and lower outlets 70 except for the hydraulic drive outlets 99.

The gear chain of the gear assembly 84 is illustrated as forming a reduction gear assembly. That is the valve body 72 is moved between the two positions by the actuator 80 over multiple rotations of the lower rotatable spray arm 34. As illustrated, the reduction gear assembly may provide a 40:1 gear reduction such that the valve body 72 will slide to the first and second positions over forty revolutions of the lower rotatable spray arm 34. The gear ratios of the gear assembly 84 may be selected to control the relative movement of the valve body 72 to the lower rotatable spray arm 34. The gear ratio of the gear assembly 84 is a function of the ratios of gears forming the gear assembly 84. Thus, the gears may be selected to provide a desired ratio to provide a desired fluid coupling time between the liquid passage 66 and the upper outlets 68 and the lower outlets 70. The gear reduction ratio may also be selected to aid in allowing the hydraulic drive outlets 99 to overcome the friction created by the valve body 72. To generate the greatest torque, the drive outlets 99 may be located near the tip of the body 56, which is the greatest distance from the axis of rotation.

As the lower rotatable spray arm 34 turns, the valve body 72 continues to move between the first and second positions and continues to selectively fluidly couple some of the upper outlets 68 and some of the lower outlets 70. The amount of time that the multiple openings 75 and 77 are fluidly coupled with each of the upper outlets 68 and the lower outlets 70, respectively, controls the duration of the time that each of the upper outlets 68 and the lower outlets 70 spray liquid. The time of fluid coupling may be thought of as a dwell time. With the above described valve body 72 and actuator 80, the dwell time may be controlled by the gear ratio, the spacing between the two opposing walls 95, 96 extending around the pin 92, and the flow rate of liquid. The movement of the lower rotatable spray arm 34 and the valve body 72 ends when fluid is no longer pumped by the recirculation pump 46 to the lower rotatable spray arm 34 such that the lower rotatable spray arm 34 is no longer hydraulically driven.

Instead of being hydraulically driven, a drive system may be included to control the rotation of the lower rotatable spray arm 34. Such a drive system may be motor-driven. For example, an electric motor (not shown) may be provided externally of the tub 18 and may be operably coupled to a portion of the lower rotatable spray arm 34 to rotate the lower rotatable spray arm 34. If the lower rotatable spray arm 34 is motor operated, the valve body 72 may be moved as the lower rotatable spray arm 34 rotates regardless of the flow rate provided by the recirculation pump 46. A motor driven lower rotatable spray arm 34 may be useful in instances where no hydraulic drive outlets are provided. Such a motor driven lower rotatable spray arm 34 may also allow for longer dwell times. In this manner, zonal washing, may be accomplished within the treating chamber 20 because the motor may have the ability to manipulate the speed of rotation of the lower rotatable spray arm 34 such that the controller 14 may control the spray emitted from the upper outlets 68 and the lower outlets 70 in pre-selected areas of the treating chamber 20.

Figure 4A:
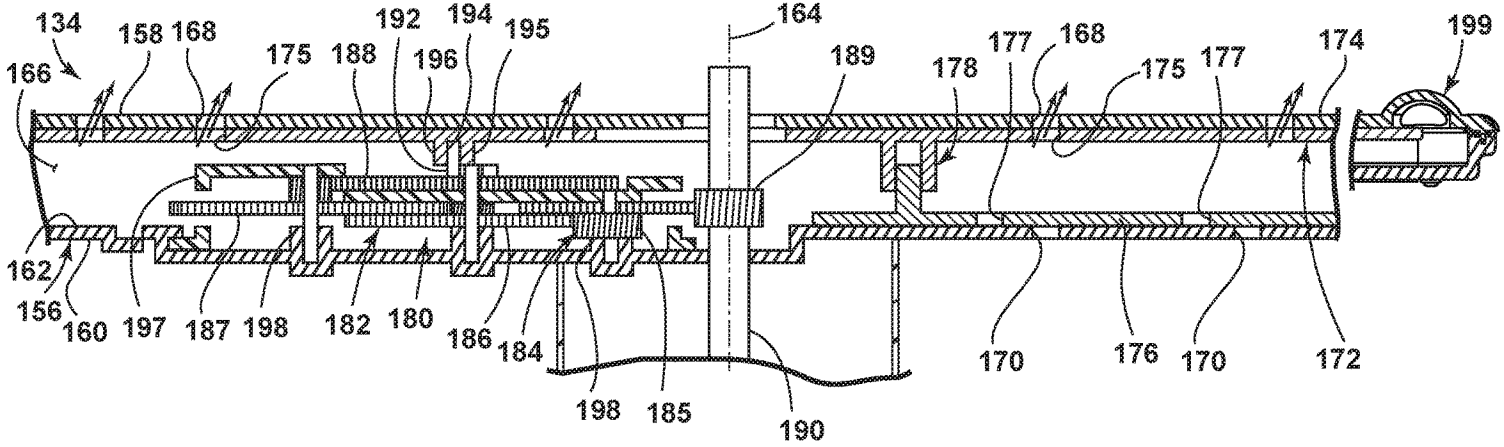
FIGS. 4A-4B are cross-sectional views of a rotatable spray arm according to another embodiment that may be used in the dishwasher of FIG. 1 and illustrating a valve body for the rotatable spray arm in various positions.

FIG. 4A illustrates a cross-sectional view of an alternative lower rotatable spray arm 134 according to a second embodiment of the invention. The lower rotatable spray arm 134 is similar to the lower rotatable spray arm 34 previously described and therefore, like parts will be identified with like numerals increased by 100, with it being understood that the description of the like parts of the lower rotatable spray arm 34 applies to the lower rotatable spray arm 134, unless otherwise noted.

One difference is that the body 156 and the valve body 172 are configured such that the valve body 172 is moveable relative to the body 156 to alternately fluidly couple the upper outlets 168 and the lower outlets 170 to the liquid passage 166. In the exemplary illustration, the body 156 includes fewer upper outlets 168 and lower outlets 170 and that the openings 175 and 177 are arranged such that only the upper outlets 168 or the lower outlets 170 are coupled to the liquid passage 166.

Figure 4B:
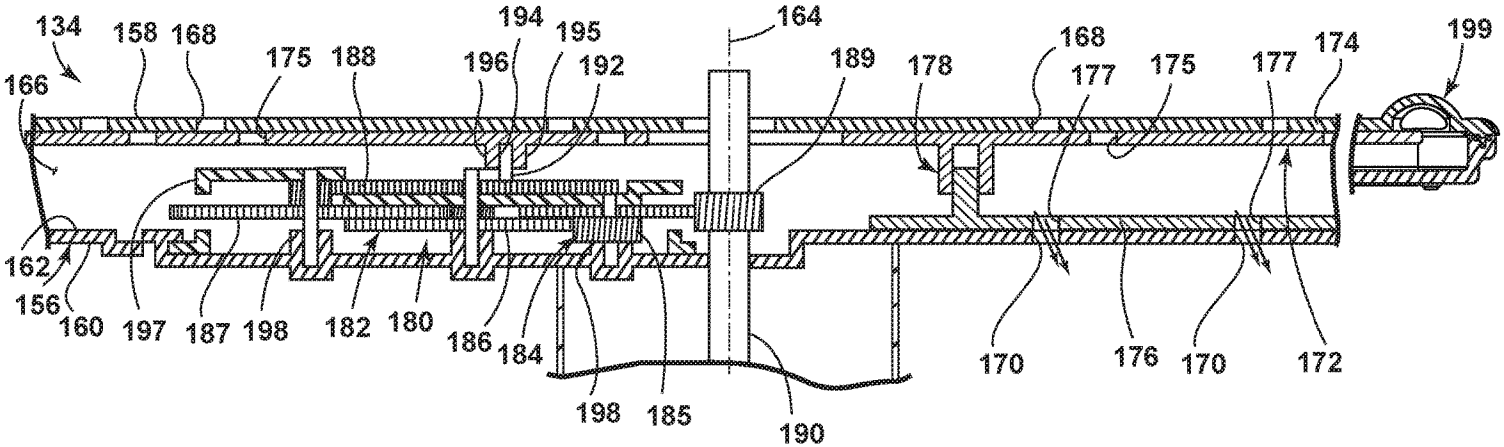

During operation, the lower rotatable spray arm 134, valve body 172, and actuator 180 operate much the same as in the first embodiment wherein as the lower rotatable spray arm 134 is rotated, the gears in the gear assembly 184 are driven and the upper slidable plate 174 and the lower slidable plate 176 are moved between first and second positions. In the first position, as illustrated in FIG. 4A, at least some of the upper outlets 168 are fluidly coupled to the liquid passage 166 and none of the lower outlets 170 are fluidly coupled to the liquid passage 166. In the second position, as illustrated in FIG. 4B, at least some of the lower outlets 170 are coupled to the liquid passage 166 and none of the upper outlets 168 are fluidly coupled to the liquid passage 166. In the illustrated example, the valve body 172 is moveable between the first position, in which all of the upper outlets 168 are coupled to the liquid passage 166, and the second position, in which all of the lower outlets 170 are coupled to the liquid passage 166. Movement between the first and second positions results in an alternating emission from the upper surface 158 and the lower surface 160. As illustrated the alternating emissions from the upper surface 158 and the lower surface 160 would be an equal ratio. Alternatively, the body 156 and the valve body 172 may be configured such that the valve body 172 fluidly couples the plurality of upper outlets 168 to the liquid passage 166 more frequently than the valve body 172 fluidly couples the plurality of lower outlets 170 to the liquid passage 166. While the frequency of emissions from the upper outlets 168 may be greater, it will still be understood that the actuator 180 may still operably couple to the valve body 172 to move the valve body 172 to alternately fluidly couple the upper outlets 168 and the lower outlets 170 to the liquid passage 166 based on the rotation of the body 156.

Figure 5:
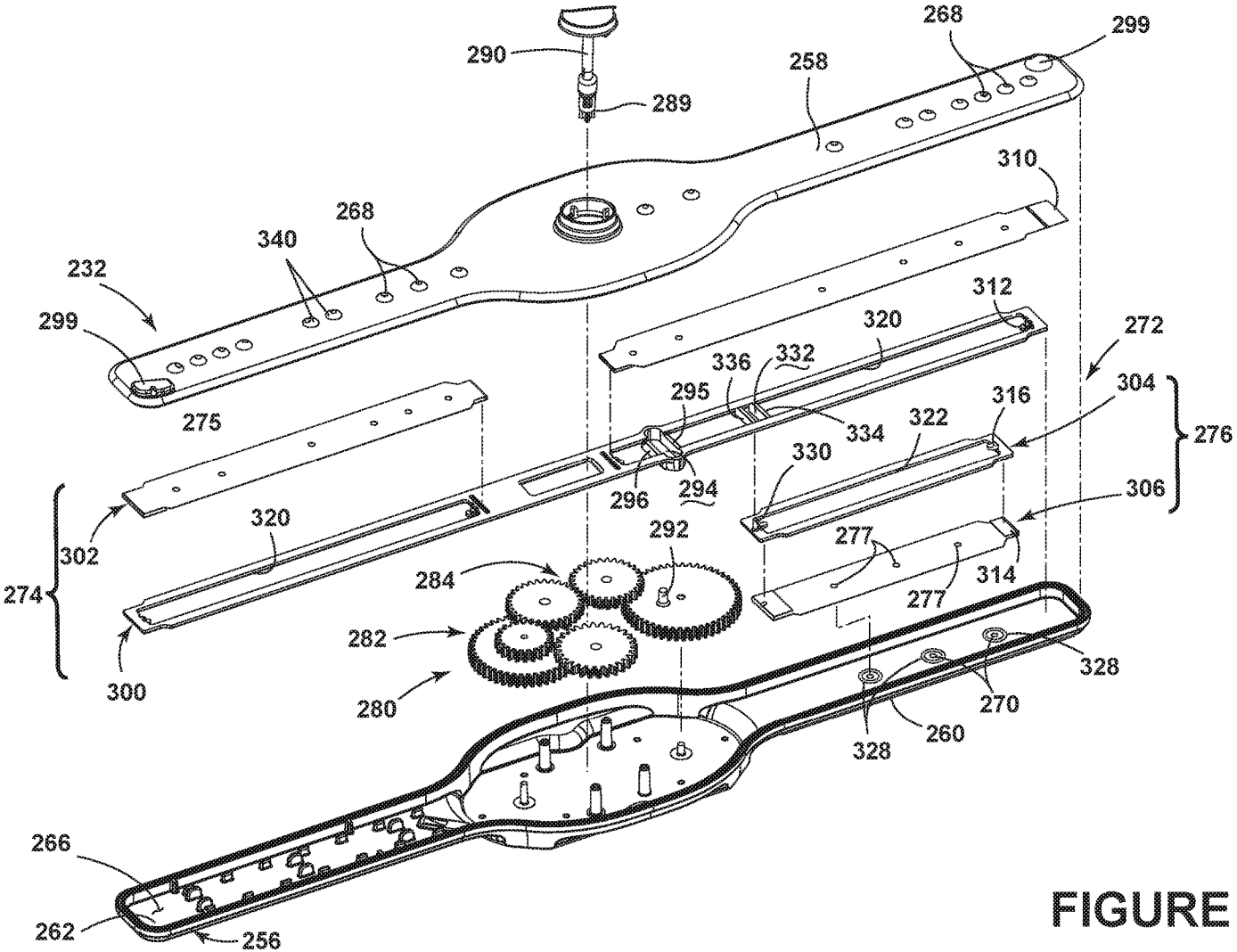
FIG. 5 is an exploded view of an exemplary rotatable spray arm according to yet another embodiment that may be sued in the dishwasher of FIG. 1.

While the embodiments described and illustrated above are with respect to the lower rotatable spray arm, it will be understood that embodiments of the invention may be used with respect to any rotatable sprayer in the dishwasher. Further, while the valve body has thus far been illustrated as including an upper slidable plate and a lower slidable plate, in the embodiments above it is contemplated that the valve body may take any suitable form including that the upper slidable plate may take any suitable form. FIG. 5 illustrates a mid-level spray arm 232 and a valve body 272 according to a third embodiment of the invention. The mid-level spray arm 232 and valve body 272 are similar to the lower rotatable spray arm 134 and valve body 172 previously described and therefore, like parts will be identified with like numerals increased by 100, with it being understood that the description of the like parts applies to the third embodiment, unless otherwise noted.

One difference is that the upper slidable plate 274 is illustrated as including an upper frame 300 supporting an upper membrane 302 and the lower slidable plate 276 is illustrated as including a lower frame 304 and a lower membrane 306. The upper and lower membranes 302 and 306 may be supported or operably coupled to the upper and lower frames 300 and 304, respectively, in any suitable manner. For example, the upper and lower membranes 302 and 306 may be attached at their ends to allow the upper and lower membranes 302 and 306 to move and conform to the body 256. In the illustrated example, end portions 310 of the upper membrane 302 may be wrapped around end portions of the upper frame 300. Tabs 312 may be used to retain the upper membrane 302 on the upper frame 300. Similarly, end portions 314 of the lower membrane 306 may be wrapped around end portions of the lower frame 304 and tabs 316 may be used to retain the lower membrane 306. While separate upper and lower frames 300 and 304 have been illustrated it is contemplated that a single frame may be used.

The upper membrane 302 may include openings 275 and the lower membrane 306 may include openings 277 all of which may be in fluid communication with the liquid passage 266. The upper frame 300 may include open portions 320 and the lower frame 304 may include open portions 322 to allow liquid to reach the upper and lower membranes 302 and 306 from the liquid passage 266.

The upper and lower membranes 302 and 306 may be formed from any suitable material. For example, the upper and lower membranes 302 and 306 may be formed from a flexible material such that they may conform to a shape of at least a portion of the mid-level rotatable spray arm 232 during use. The material may be able to withstand the high temperatures of the dishwasher 10 and the treating chemistry that is used in dishwasher 10.

As with the earlier embodiment, the mid-level rotatable spray arm 232 includes an interior 262 forming a liquid passage 266. The upper membrane 302 and the lower membrane 306 may be located within the interior 262 and may abut portions of the mid-level rotatable spray arm 232. For example, the upper membrane 302 abuts the upper surface 258 of the mid-level rotatable spray arm 232 to form a liquid seal between the mid-level rotatable spray arm 232 and the remainder of the liquid passage 266. The lower membrane 306 abuts the lower surface 260 of the mid-level rotatable spray arm 232 to form a liquid seal between the mid-level rotatable spray arm 232 and the remainder of the liquid passage 266.

Sealing rings 328 may be provided along the interior 262 of the body 256, with one of the sealing rings 328 surrounding each of the upper outlets 268 and the lower outlets 270. The sealing ring 328 may create a larger effective outlet and allows for a longer fluid communication between the upper outlets 268 or the lower outlets 270 and the liquid passage 266. The sealing ring 328 may be a raised ring surrounding each upper outlet 268 and lower outlet 270 and may take any suitable form including that of an O-ring or other seal. The upper and lower membranes 302 and 306 may be capable of sealing against the body 256 and/or the sealing rings 328 to better seal the upper outlets 268 and the lower outlets 270 against the unintended flow of liquid from the liquid passage 266.

The drive system 282 has been illustrated as including a gear assembly 284 operably coupling the mid-level rotatable spray arm 232 and the valve body 272 such that rotation of the mid-level rotatable spray arm 232 moves the gear assembly 284, which in turn moves the upper slidable plate 274 that in turn moves the lower slidable plate 276. The gear assembly 284 has been illustrated as including an additional gear and having a more horizontal layout as compared to the earlier described embodiments. The gear assembly 284 helps convert the rotational motion of the mid-level rotatable spray arm 232 into sliding motion of a reciprocating driver that relatively reciprocates the upper and lower membranes 302 and 306 and the mid-level rotatable spray arm 232. In the illustrated example, the reciprocating driver includes the upper frame 300 and lower frame 304. Alternatively, the reciprocating driver may reciprocate the upper and lower membranes 302 and 306 relative to the driver. For example, while the membranes are illustrated as being used in conjunction with the frames it is contemplated that the membranes may be operably coupled to the drive system 282 without the use of the frames.

The drive system 282 may also include a pin 292 operably coupled with and extending from an upper portion of a gear of the gear assembly 284 and received within a channel 294 located in the frame 300 to operably couple the gear assembly 284 with the upper slidable plate 274. The channel 294 may be a depression in a bottom portion of the upper frame 300 or as illustrated may be formed between two opposing walls 295, 296 formed in the upper frame 300. The membrane 302 and the mid-level rotatable spray arm 232 may be coupled for relative movement and the drive system 282 may reciprocate the membrane 302 relative to the mid-level rotatable spray arm 232.

A coupling mechanism 278 operably couples the upper frame 300 and the lower frame 304. Any suitable coupling mechanism 278 may be utilized. In the illustrated example, a pin 330 operably coupled with and extending from the lower frame 304 is received within a channel 332 located in the frame 300 to form the coupling mechanism 278. The channel 332 may be a depression in a bottom portion of the upper frame 300 or as illustrated may be formed between two opposing walls 334, 336 formed in the upper frame 300. In this manner, the upper and lower membrane 302 and 306 may be coupled so that motion to the upper frame 300 is transferred to the lower frame 304.

It will be understood that any suitable drive assembly may be used to move the upper membrane 302 and lower membrane 306. For example, a different gear assembly may be used to achieve a higher gear reduction and longer dwell time.

Yet another difference is that additional nozzle structures 340 are provided on the body 256 and may be fluidly coupled with the upper outlets 268. While not illustrated, nozzles may also be included on the lower surface 260 of the body 256. It is contemplated that any suitable nozzles may be operably coupled to the body 256 and that the nozzles 340 may provide any number of different spray patterns, including that the nozzles 340 may provide different spray patterns, although this need not be the case. Providing different spray patterns may be advantageous so as to provide for different cleaning effects from a single spray arm. For example, a first spray pattern may be a discrete, focused, and concentrated spray, which may provide a higher pressure spray. While a second spray pattern may be a wide angle diffused spray pattern that produces more of a shower as compared to a more concentrated spray pattern. The shower spray may be more suitable for distributing treating chemistry whereas the higher pressure spray may be more suitable for dislodging soils.

During operation, the mid-level rotatable spray arm 232 and drive system 282 operate much the same as in the second embodiment wherein as the mid-level rotatable spray arm 232 is rotated, gears in the drive system 282 are driven and the upper and lower frames 300 and 304 are moved between the first and second positions to alternately fluidly couple the upper outlets 268 and the lower outlets 270 to the liquid passage 266.

There are several advantages of the present disclosure arising from the various features of the apparatuses described herein. For example, the embodiments described above allow for liquid to be emitted from both the upper and lower portions of the rotatable body. The embodiments described above allow for better coverage of the treating chamber 20 without utilizing more water.

While the invention has been specifically described in connection with certain specific embodiments thereof, it is to be understood that this is by way of illustration and not of limitation. For example, other actuators may be used to control the movement of the valve body based on the rotation of the rotatable body and the illustrated actuators including gear assemblies are merely exemplary. Further, while the valve body has been illustrated and described as moving in a linear motion, it is contemplated that the valve body may alternatively be moved in any suitable manner including rotational motion or orbital motion. Further, while the bodies have been described and illustrated as being in the form of spray arms it will be understood that any suitable sprayer and body may be used in any of the above embodiments. For example, the body may include a rotatable disk where the disk rotates and the actuator moves the valve body within the disk to fluidly couple the upper outlets and lower outlets to the liquid passage.

The patentable scope of the invention is defined by the claims, and may include other examples that occur to those skilled in the art. It will be understood that any features of the above described embodiments may be combined in any manner. Reasonable variation and modification are possible within the scope of the forgoing disclosure and drawings without departing from the spirit of the invention which is defined in the appended claims.

What is claimed is:

1. A dishwasher for washing dishes according to an automatic cycle of operation, comprising:

a tub at least partially defining a treating chamber for receiving dishes for cleaning; and a spraying system supplying liquid to the treating chamber and having a sprayer comprising:

a rotatable sprayer body mounted within the tub for rotation about an axis and having an upper surface, a lower surface, and an interior;

a liquid passage provided in the interior;

at least one upper outlet extending through the upper surface of the rotatable sprayer body and in fluid communication with the liquid passage;

at least one lower outlet extending through the lower surface of the rotatable sprayer body and in fluid communication with the liquid passage;

a valve body moveable relative to the rotatable sprayer body to selectively fluidly couple the at least one upper outlet to the liquid passage and to selectively fluidly couple the at least one lower outlet to the liquid passage where the valve body comprise an upper portion that has at least one opening that aligns with the at least one upper outlet during its movement and a lower portion that has at least one opening that aligns with the at least one lower outlet during its movement; and a drive mechanism operably coupling the rotatable sprayer body and the valve body and where the drive mechanism is configured to convert rotational motion of the rotatable sprayer body into a lateral motion to laterally reciprocate the valve body with respect to the rotatable sprayer body to selectively fluidly couple the at least one upper outlet to the liquid passage and to selectively fluidly couple the at least one lower outlet to the liquid passage wherein the selectively fluidly coupling of the at least one upper outlet and the at least one lower outlet to the liquid passage results in emissions of liquid from the upper surface and the lower surface of the sprayer, respectively.

2. The dishwasher of claim 1 wherein the drive mechanism comprises a gear assembly configured to convert rotational motion of the rotatable sprayer body into a lateral output.

3. The dishwasher of claim 2 wherein the drive mechanism further comprises a reciprocating driver that is configured to laterally reciprocate the valve body based upon the lateral output from the gear assembly.

4. The dishwasher of claim 1 wherein the sprayer comprises a plurality of upper outlets and a plurality of lower outlets.

5. The dishwasher of claim 4 wherein the valve body is configured to selectively fluidly couple a subset of the plurality of upper outlets to the liquid passage and to selectively fluidly couple a subset of the plurality of lower outlets to the liquid passage.

6. The dishwasher of claim 4 wherein the valve body is moveable between a first position in which at least some of the plurality of upper outlets are coupled to the liquid passage and a second position in which at least some of the plurality of lower outlets are coupled to the liquid passage.

7. The dishwasher of claim 6 wherein the valve body fluidly couples the plurality of upper outlets to the liquid passage more frequently than the valve body fluidly couples the plurality of lower outlets to the liquid passage.

8. The dishwasher of claim 6 wherein the valve body is moveable between a first position in which all of the upper outlets are coupled to the liquid passage and a second position in which all of the lower outlets are coupled to the liquid passage.

9. The dishwasher of claim 1 wherein the valve body is located within the rotatable sprayer body.

10. The dishwasher of claim 1 wherein the valve body comprises an upper slidable plate that has at least one opening that aligns with the at least one upper outlet and a lower slidable plate that has at least one opening that aligns with the at least one lower outlet.

11. The dishwasher of claim 10 wherein the upper slidable plate includes an upper membrane and the at least one opening is formed in the upper membrane and the lower slidable plate includes a lower membrane and the at least one opening is formed in the lower membrane.

12. The dishwasher of claim 11 wherein the upper slidable plate and the lower slidable plate are operably coupled and move in tandem.

13. The dishwasher of claim 11 wherein each of the upper and lower membranes abut portions of the rotatable sprayer body to form a liquid seal between the portions of the rotatable sprayer body and the liquid passage.

14. A dishwasher for washing dishes according to an automatic cycle of operation, comprising:

a tub at least partially defining a treating chamber for receiving dishes for cleaning; and a spraying system supplying liquid to the treating chamber and having a sprayer comprising:

a rotatable sprayer body mounted within the tub for movement about a rotatable axis and having an upper surface, a lower surface, and an interior;

a liquid passage provided in the interior;

at least one upper outlet extending through the upper surface of the rotatable sprayer body and in fluid communication with the liquid passage;

at least one lower outlet extending through the lower surface of the rotatable sprayer body and in fluid communication with the liquid passage;

a valve body moveable relative to the rotatable sprayer body to selectively fluidly couple the at least one upper outlet to the liquid passage and to selectively fluidly couple the at least one lower outlet to the liquid passage where the valve body comprise an upper portion that has at least one opening that aligns with the at least one upper outlet during its movement and a lower portion that has at least one opening that aligns with the at least one lower outlet during its movement; and a drive system having a gear train assembly that converts rotational motion of the rotatable sprayer body into reciprocal movement of the upper portion and the lower portion;

wherein the upper portion and the lower portion include slidable plates that are operably coupled together such that reciprocal movement of one in turn moves the other.

15. The dishwasher of claim 14 wherein the at least one upper outlet and the at least one lower outlet are periodically simultaneously coupled to the liquid passage.

16. The dishwasher of claim 14 wherein the valve body moves relative to the rotatable sprayer body to alternately couple the at least one upper outlet to the liquid passage and the at least one lower outlet to the liquid passage.

17. The dishwasher of claim 14 wherein the sprayer comprises a plurality of upper outlets and a plurality of lower outlets.

18. The dishwasher of claim 14 wherein the upper slidable plate includes an upper membrane and the at least one opening is formed in the upper membrane and the lower slidable plate includes a lower membrane and the at least one opening is formed in the lower membrane.

19. The dishwasher of claim 18 wherein each of the upper and lower membranes abut portions of the rotatable sprayer body to form a liquid seal between the portions of the rotatable sprayer body and the liquid passage.

* * * * *